US006782864B2

(12) United States Patent
Takagi et al.

(10) Patent No.: US 6,782,864 B2
(45) Date of Patent: Aug. 31, 2004

(54) MOUNT STRUCTURE FOR AN ENGINE ACCESSORY

(75) Inventors: Kiyoshi Takagi, Saitama (JP); Yoshiaki Iizuka, Saitama (JP); Naoki Takahara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 13 days.

(21) Appl. No.: 10/191,307

(22) Filed: Jul. 9, 2002

(65) Prior Publication Data

US 2003/0041835 A1 Mar. 6, 2003

(30) Foreign Application Priority Data

Sep. 3, 2001 (JP) ..... 2001-266572

(51) Int. Cl.[7] ..... F02F 7/00
(52) U.S. Cl. ..... 123/195 A; 123/198 R
(58) Field of Search ..... 123/195 A, 193.5, 123/198 R

(56) References Cited

U.S. PATENT DOCUMENTS 6,076,492 A * 6/2000 Takahashi ..... 123/90.17
6,148,787 A * 11/2000 Takano ..... 123/195 A

FOREIGN PATENT DOCUMENTS

| | | | | |
|---|---|---|---|---|
| JP | 06-8735 | | 2/1994 | |
| JP | 11-148443 | | 6/1999 | |
| JP | 11148443 A | * | 6/1999 | ..... F02M/55/02 |
| JP | 2000-240743 | | 9/2000 | |
| JP | 2001-227407 | | 8/2001 | |
| JP | 2001227407 A | * | 8/2001 | ..... F02F/1/24 |

* cited by examiner

*Primary Examiner*—Noah P. Kamen
(74) *Attorney, Agent, or Firm*—Fish & Richardson P.C.

(57) ABSTRACT

In a cylinder head of an engine having an intake port communicating with an combustion chamber of the engine, a mount structure for an engine accessory includes an engine accessory, an accessory mount portion provided on the cylinder head and to which the engine accessory is mounted, and a fuel injection device mount portion provided on the cylinder head and to which a fuel injection device for injecting fuel into the intake port is mounted. The accessory mount portion is joined to the fuel injection device mount portion.

18 Claims, 5 Drawing Sheets

MOUNT STRUCTURE FOR AN ENGINE ACCESSORY

FIELD OF THE INVENTION

The present invention relates to a mount structure for an engine accessory, and more particularly to a mount structure for an engine accessory which improves stiffness of a mount for an accessory without increasing the weight of the engine.

BACKGROUND OF THE INVENTION

Generally, various kinds of accessories are provided for keeping up and improving the performance of the engine. Each accessory is mounted on the engine block at an appropriate position in accordance with its purpose. For example, when a rotation driving force is required to drive an accessory, the accessory is mounted on the engine at the timing belt side in such a manner that the accessory is wound around by the timing belt or a belt for driving other accessories. If the accessory does not require a rotation driving force and is provided for the control purpose, the accessory is mounted at a position adjacent to the controlled object in accordance with its function. For example, an EGR valve for controlling the flow rate of recirculation flow of exhaust gas flowing to the intake side or a spool valve such as disclosed in Japanese Laid-open Patent Application No. 2000-240743 for switching hydraulic pressure to drive a variable valve timing mechanism is mounted at one side of the cylinder head positioned upward of the engine.

When various kinds of accessories are mounted on the engine, a necessary and sufficient stiffness is required for each mount in order to prevent damage around the joint of the mount portion or malfunction of the accessory by a vibratory force due to vibration of the engine. Particularly, in the case of an accessory for feeding hydraulic pressure to the cylinder head, a sufficient stiffness is required at the mount portion because of the necessity to ensure a good sealing performance to prevent leakage of hydraulic fluid from the joint surface.

However, in the case that an accessory is mounted at the intake side of the cylinder head, if the mount portion is formed too thick in order to ensure a sufficient stiffness, the weight of the engine will increase disadvantageously.

Meanwhile, in the case that an accessory is mounted at the exhaust side of the cylinder head, the mount portion has to project to a certain extent away from the cylinder head such that the accessory is not subjected to excessive heat from the cylinder head. Such a mount structure will also increase the weight of the engine, leading to deterioration of the fuel economy and the like.

In order to eliminate the aforementioned drawbacks, the present invention seeks to provide a mount structure for an engine accessory which ensures the attachment of the engine accessories with high stiffness and with minimum increase in the weight of the engine.

SUMMARY OF THE INVENTION

According to a first aspect of the invention, there is provided a mount structure for an engine accessory. In a cylinder head of an engine having an intake port communicating with an combustion chamber of the engine, the mount structure comprises: an engine accessory; an accessory mount portion provided on the cylinder head and to which the engine accessory is mounted; and a fuel injection device mount portion provided on the cylinder head and to which a fuel injection device is mounted, the fuel injection device injecting fuel into the intake port; wherein the accessory mount portion is joined to the fuel injection device mount portion.

In this mount structure for an engine accessory, since the fuel injection device mount portion and the accessory mount portion are joined together, the accessory mount portion and the fuel injection device mount portion are reinforced with each other to provide high stiffness. Further, since the engine accessory is mounted at the intake side of the engine, the temperature of the accessory mount portion is lower than the case where the engine accessory is mounted at the exhaust side. Therefore, it is not necessary for the engine accessory to keep so much distance away from the cylinder head. This leads to improvement of stiffness without excessively increasing the thickness of the mount portion.

According to a second aspect of the invention, there is provided a mount structure for an engine accessory. In a cylinder head of an engine having an intake port communicating with an combustion chamber of the engine, the mount structure comprises: an engine accessory; an accessory mount portion provided on the cylinder head and to which the engine accessory is mounted; and a cooling water pipe mount portion provided on the cylinder head and to which a cooling water pipe is mounted, the cooling water pipe circulating therein cooling water for cooling the interior of the engine; wherein the accessory mount portion is joined to the cooling water pipe mount portion.

In this mount structure for an engine accessory, since the accessory mount portion and the cooling water pipe mount portion are reinforced with each other, stiffness of the accessory mount portion is improved. Further, since the engine accessory is mounted adjacently to the cooling water pipe mount portion, it is possible to restrict excessive increase in temperature around the accessory mount portion. Therefore, it is not necessary to project the accessory mount portion from the cylinder head, which reduces the entire size of the engine.

According to a third aspect of the invention, there is provided a mount structure for an engine accessory. In a cylinder head of an engine having an intake port communicating with an combustion chamber of the engine, the mount structure comprises: an engine accessory; an accessory mount portion provided on the cylinder head and to which the engine accessory is mounted; and an intake manifold mount portion provided on the cylinder head and to which an intake manifold is mounted, the intake manifold communicating with the intake port; wherein the accessory mount portion is joined to the intake manifold mount portion.

In this mount structure for an engine accessory, since the accessory mount portion and the intake manifold mount portion are reinforced with each other, stiffness of the accessory mount portion is improved. Further, since the engine accessory mount portion and the intake manifold mount portion are joined together, it is possible to restrict excessive increase in temperature around the accessory mount portion. Therefore, it is not necessary to project the accessory mount portion from the cylinder head, which reduces the entire size of the engine.

Preferably, in the aforementioned mount structures, the intake port is bent in such a manner that an upstream side of the intake port is away from the accessory mount portion.

In such a mount structure for an engine accessory, since the accessory mount portion is arranged near to the fuel injection device mount portion or the intake manifold mount portion, it is possible to provide the accessory mount portion on the cylinder head without projecting outward in the direction of the output shaft of the engine and without increasing the entire size of the engine. In other words, since the upstream of the intake port is bent in a direction away from the accessory mount portion, the accessory mount portion can be positioned toward the center part of the engine, thereby allowing the entire size of the engine to be downsized as well as permitting much more sufficient joint of the accessory mount portion to the fuel injection device mount portion or the intake manifold mount portion. This can provide a mount structure for an engine accessory having high stiffness without increasing the weight.

Further, it is preferable that an intake manifold mount surface of the intake manifold mount portion and an accessory mount surface of the accessory mount portion are formed in the same plane. In this mount structure for an engine accessory, since the intake manifold mount surface and the engine accessory mount surface are formed in the same plane, these two surfaces can be machined and finished simultaneously, thereby reducing the production cost.

BRIEF DESCRIPTION OF THE DRAWINGS

A preferred embodiment of the present invention will be described below, by way of example only, with reference to the accompanying drawings, in which.

DESCRIPTION OF THE PREFERRED EMBODIMENT

Figure 1:
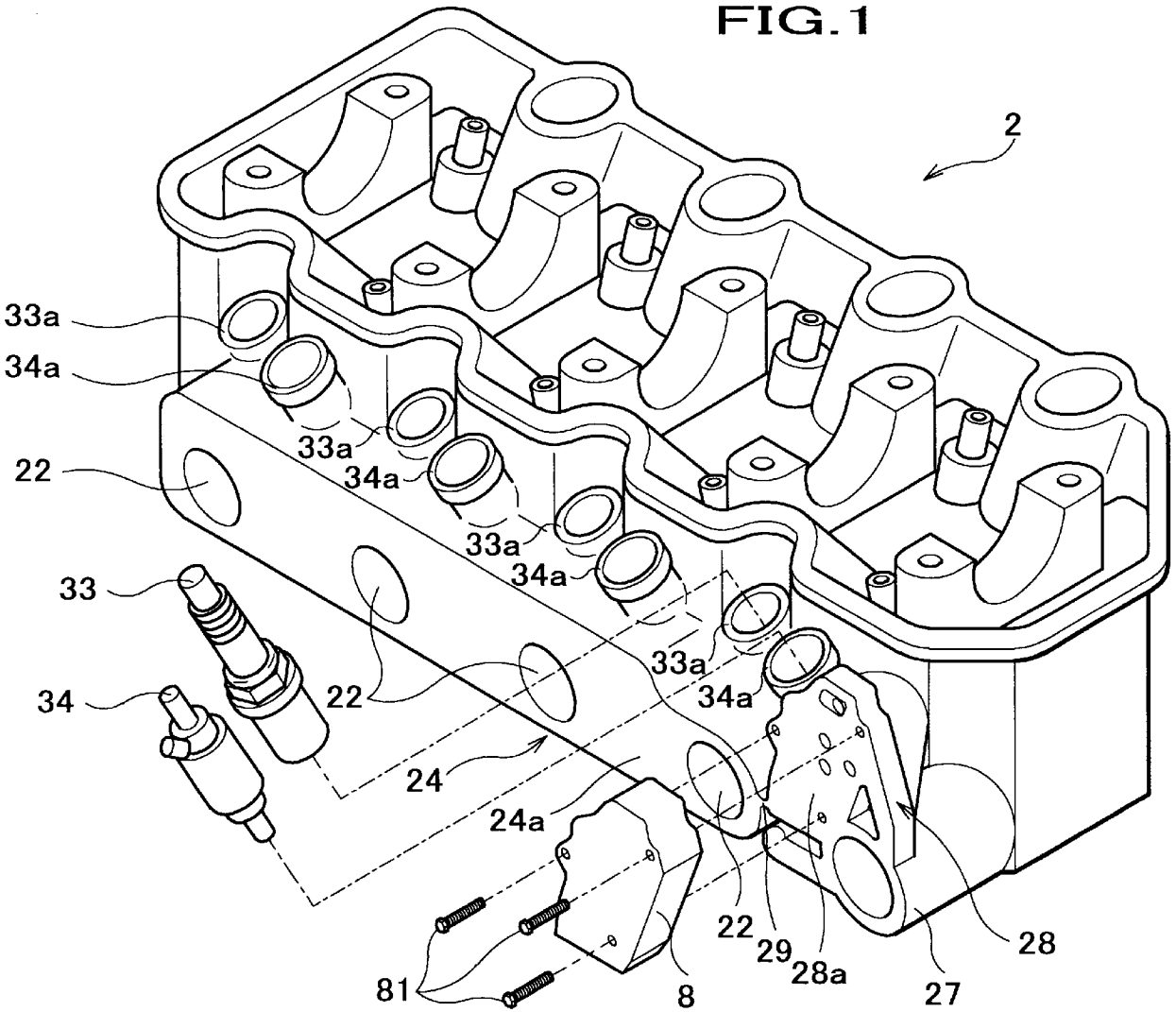
FIG. 1 is a perspective view of a cylinder head.
Figure 3:
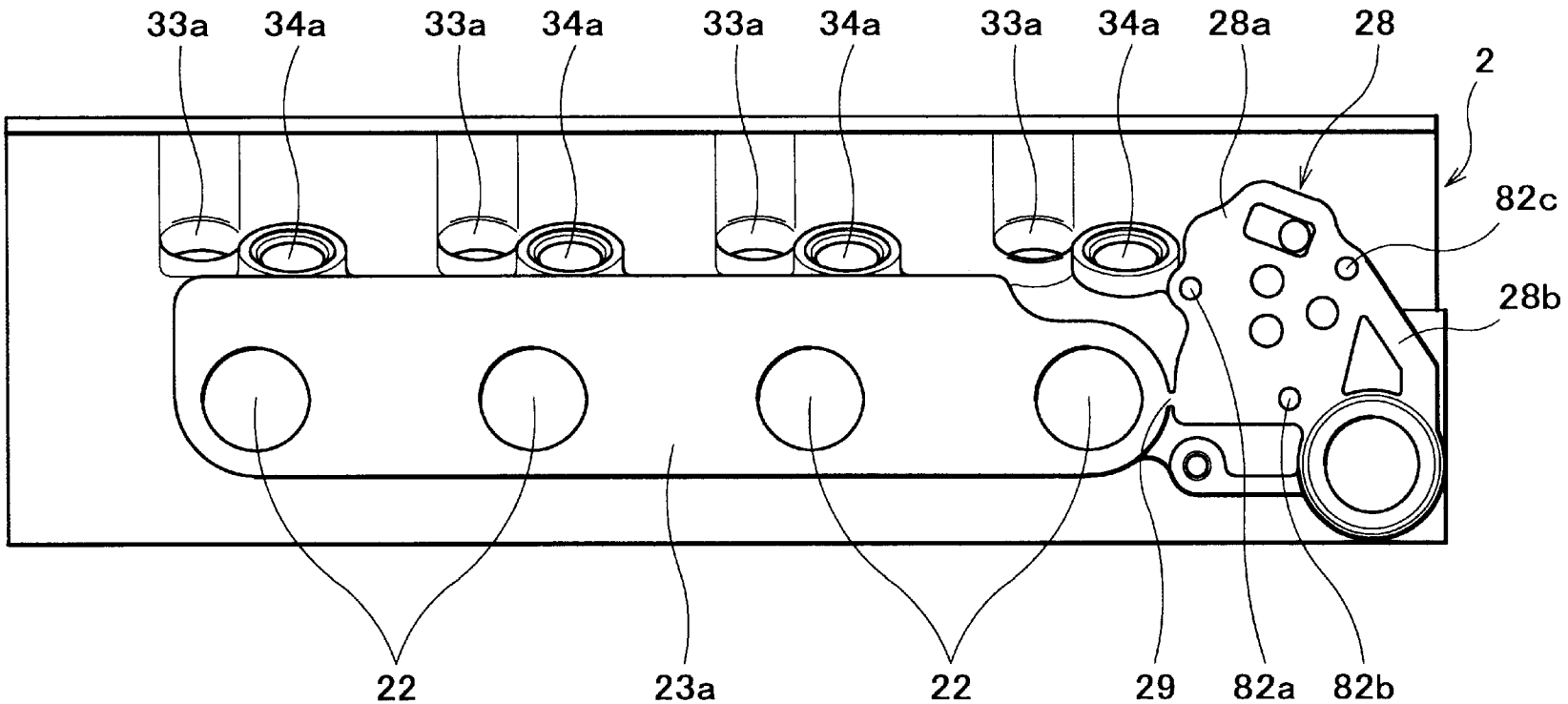
FIG. 3 is a side view of the intake side of the cylinder head.
Figure 4:
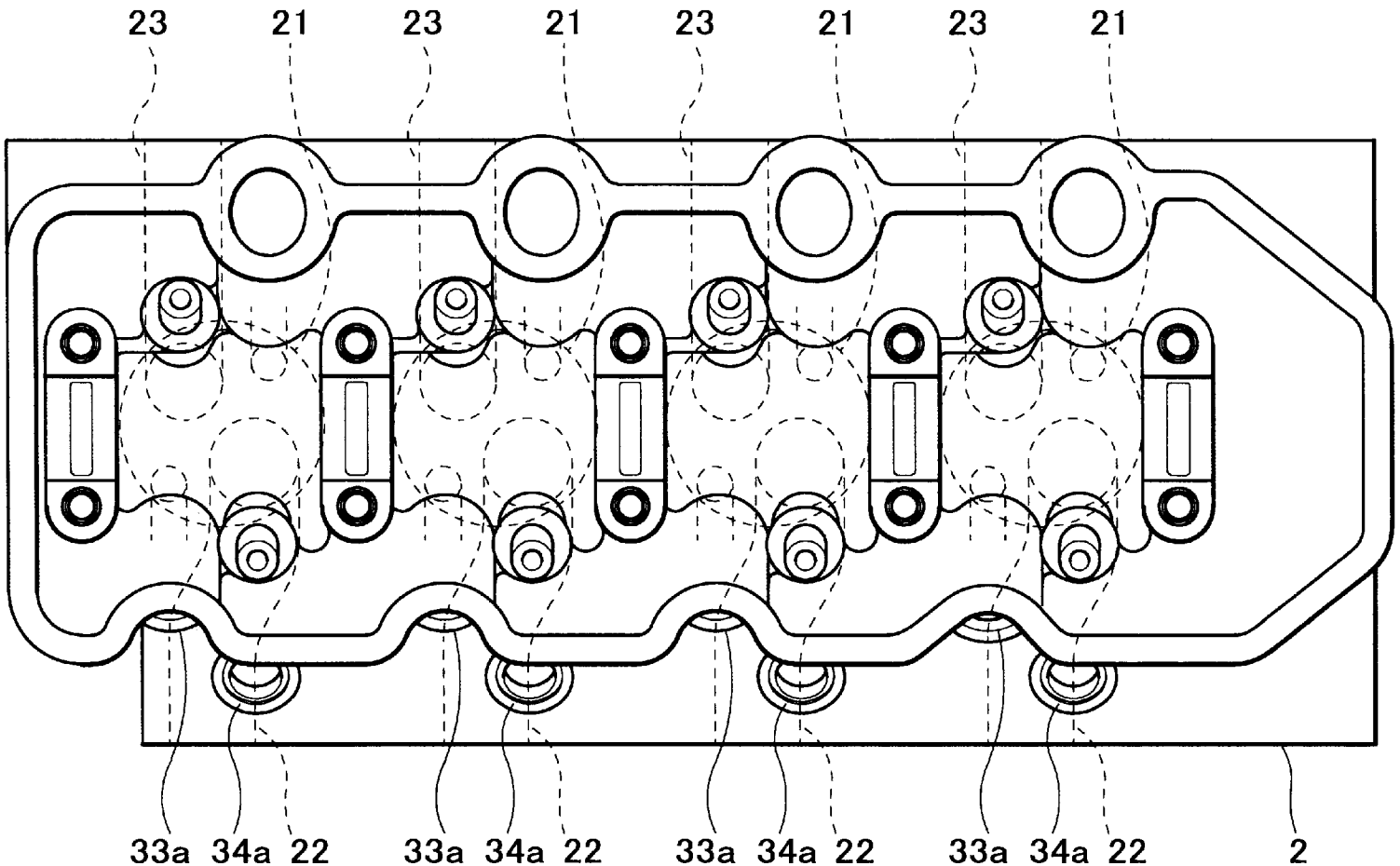
FIG. 4 is a plan view of the cylinder head.
Figure 5:
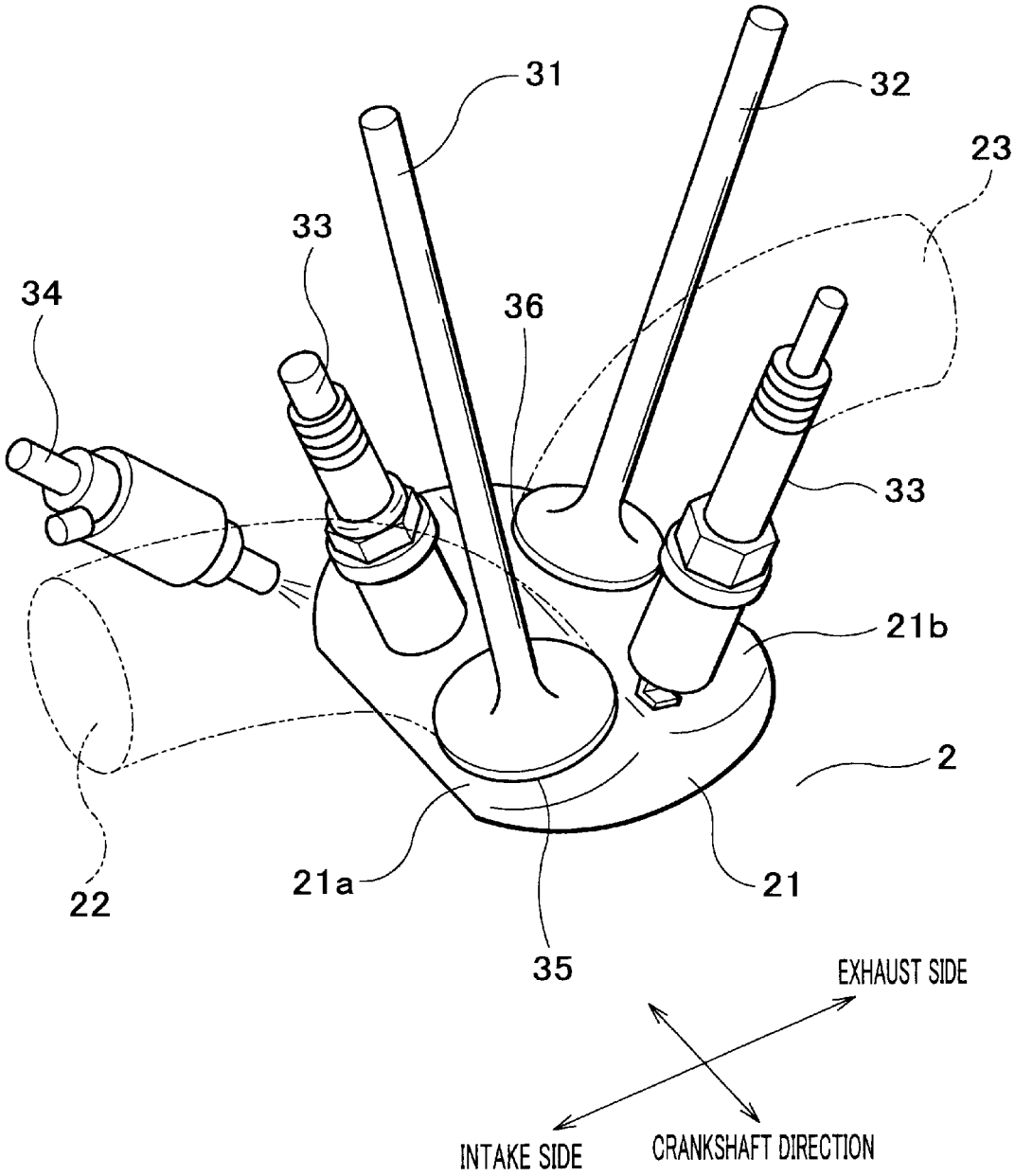
FIG. 5 is a perspective view illustrating an arrangement of valves, spark plugs, and a fuel injection device in the cylinder head.

With reference to the accompanying drawings, a preferred embodiment of the invention will be described. As the drawings to be referred herein, FIG. 1 is a perspective view illustrating a cylinder head of an engine and an engine accessory according to one preferred embodiment of the invention, FIG. 2 is an exploded perspective view of blocks constructing the engine, FIG. 3 is a side view of the intake side of the cylinder head, FIG. 4 is a plan view of the cylinder head, and FIG. 5 is a perspective view illustrating an arrangement of valves, spark plugs, and a fuel injection device in the cylinder head.

The engine 1 is an inline 4-cylinder gasoline engine. With reference to FIG. 2, the engine 1 includes, as blocks constructing the engine 1, a cylinder block 3 having cylinders 3*b* in which pistons (not shown) reciprocate, a cylinder head 2 fixed on top of the cylinder block 3 and to which combustion chambers, an intake/exhaust system, and a valve system (to be described later) are mounted, a crankcase 4 fixed at the bottom of the cylinder block 3 and supporting a crankshaft, an oil pan 5 fixed at the bottom of the crankcase 4 and storing engine oil, and a head cover 6 covering the top of the cylinder head 2.

Figure 2:
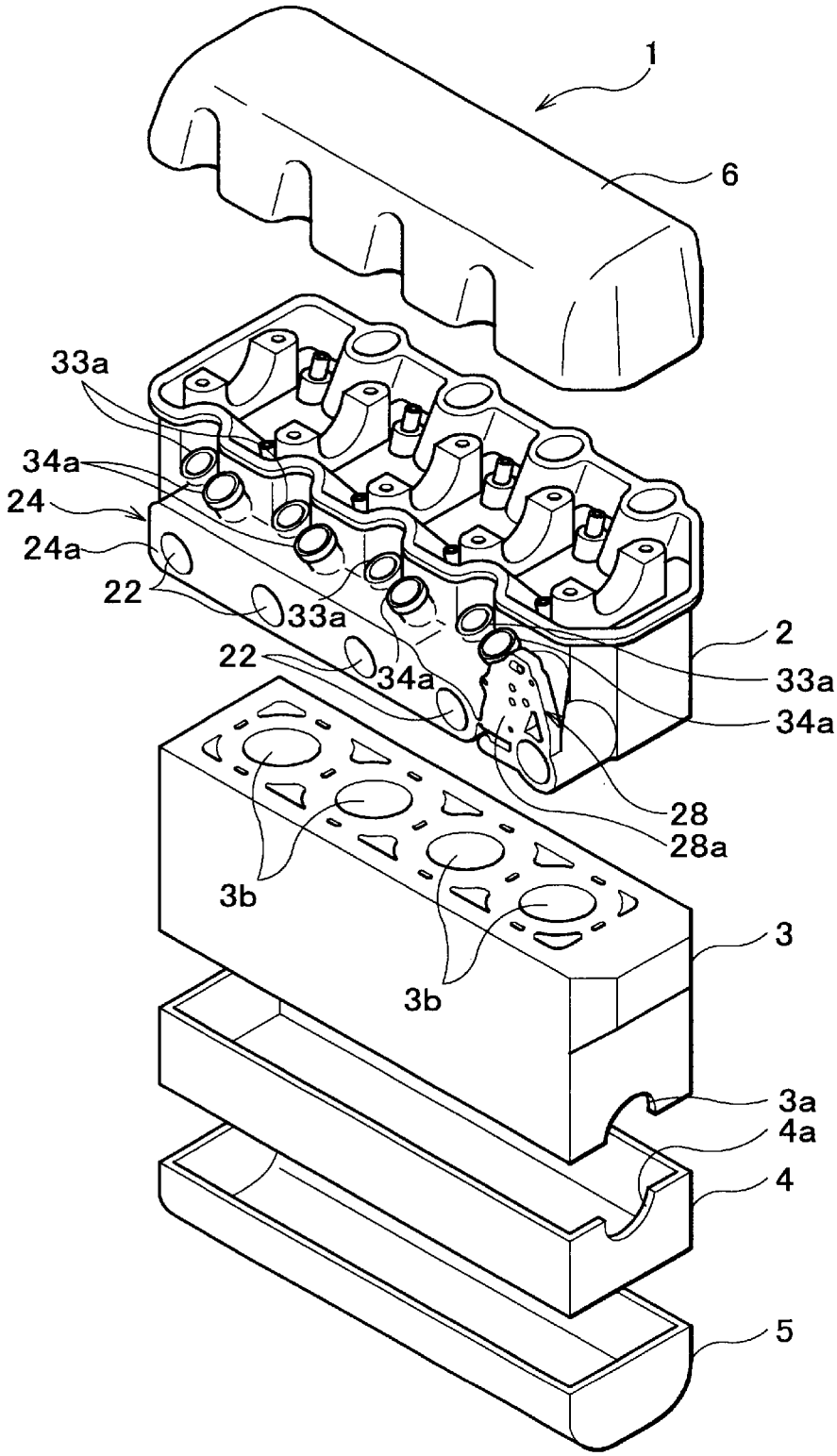
FIG. 2 is an exploded perspective view of an engine block.

In FIG. 2, mounted to the output shaft (not shown) of the engine 1 extending from a crank journal portions 3*a*, 4*a* arranged at the right-hand near side (as seen in the drawing) of the cylinder block 3 and the crankcase 4 is a transmission system through which power is transmitted, while the speed is decreased, to the driving wheels. Mounted at the other left-hand far side are accessories (not shown) such as a generator to be rotatively driven by the power of the engine 1.

Of these blocks constructing the engine 1, the present invention particularly relates to a mount structure for an accessory 8 (see FIG. 1) which is mounted to the cylinder head 2, and therefore, the description will be focused on the cylinder head 2.

As shown in FIG. 2, the cylinder head 2 is provided with combustion chambers 21 (see FIGS. 4 and 5) each formed by a recess portion at the bottom surface of the cylinder head 2 corresponding to each cylinder 3*b*, and a plurality of intake ports 22 for introducing air into the respective combustion chambers 21 are open at one side of the cylinder head 2 to communicate with the combustion chambers 21 (see FIG. 4). A plurality of exhaust ports 23 for introducing exhaust gas resulting from combustion are open at the other side of the cylinder head 2 to communicate with the combustion chambers 21 (see FIGS. 4 and 5). Two spark plugs 33 are arranged for each combustion chamber 21 (see FIGS. 1 and 5).

As shown in FIG. 5, each intake port 22 is formed as one single pipe extending from each combustion chamber 21. This is because the engine 1 is a two-valve type where one intake valve 31 and one exhaust valve 32 are provided for each combustion chamber 21. An intake opening 35 of the combustion chamber 21 that is open and closed by the intake valve 31 is offset from the cylinder center to one side, i.e., right-hand side as seen in FIG. 4 toward the transmission system to be mounted, on an intake side semi-circular portion 21*a* above the combustion chamber 21, and one spark plug 33 is arranged at another side within the intake side semi-circular portion 21*a*.

A fuel injection device 34 for injecting fuel in accordance with operational status of the engine 1 is obliquely positioned for each intake port 22 to inject fuel to the intake opening 35. For this reason, a tubular fuel injection device mount portion 34*a* obliquely extends toward the combustion chamber 21 at a side surface of the intake side of the cylinder head 2 (see FIG. 1).

The intake port 22 bents so as to extend from the intake opening 35 provided at the top of the combustion chamber 21 to the side surface of the cylinder head 2 when viewing from the shaft direction of the crankshaft, and also bents toward the center portion of the combustion chamber 21 (toward timing chain) in a direction away from the fuel injection device mount portion 34*a* when viewing from the top as illustrated in FIG. 4.

The upstream of the intake port 22 is open at a side of the intake side of the cylinder head 2 so that an intake manifold, which introduces fresh air from an unshown air cleaner and distributes the air to each intake port 22, is mounted to this opening. In FIG. 1, the tubular portion which forms the vicinity of the inlet of the intake port 22 corresponds to the intake manifold mount portion 24, and the vertical side surface where the intake port 22 opens corresponds to the intake manifold mount surface 24*a*.

Like the intake port 22, each exhaust port 23 is formed as one single pipe extending from each combustion chamber 21. An exhaust opening 36 of the combustion chamber 21 is offset to the opposite direction of the intake opening 35, i.e., left-hand side as seen in FIG. 4 toward the timing chain, on an exhaust side semi-circular portion 21*b* above the combustion chamber 21, and one spark plug 33 is arranged at another side within the exhaust side semi-circular portion 21*b*.

As mentioned above, two spark plugs 33, one for the intake side and the other for the exhaust side, are mounted to each combustion chamber 21. However, since the distal end of the spark plug 33 has to reach to the combustion chamber 21, a spark plug insertion hole 33*a* is set back, as viewed from above the cylinder head 2, when compared with the fuel injection device mount portion 34*a*. Therefore, the fuel injection device mount portion 34*a* projects outward when compared with the spark plug insertion hole 33*a*.

As illustrated in FIG. 1, in this cylinder head 2, an accessory mount portion 28 for mounting an engine accessory 8 such as a spool valve, an EGR valve, etc., is provided at one side surface of the cylinder head 2, i.e., at the intake side surface near the transmission system. The accessory mount portion 28 is joined to the fuel injection device mount portion 34*a* in such a manner that part of the accessory mount portion 28 and part of the fuel injection device mount portion 34*a* are overlapped with each other. The accessory mount surface 28*a* to which the accessory 8 is mounted is formed in the same plane with the intake manifold mount portion 24*a*, and the accessory mount portion 28 and the intake manifold mount portion 24 are joined together. Further, the accessory mount portion 28 is partly joined to the intake manifold mount surface 24*a* at the accessory mount surface 28*a* through a connecting rib 29. Provided below the accessory mount portion 28 is a cooling water pipe mount portion 27 where a cooling water pipe, through which cooling water for cooling the engine 1 flows, is attached.

An engine accessory 8 such as a spool valve, an EGR valve, etc., is fixed to the accessory mount portion 28*a* by three bolts 81. Three bolt holes for fixing the accessory 8, i.e., a first fixing portion 82*a*, a second fixing portion 82*b*, and a third fixing portion 82*c* are provided in the accessory mount surface 28*a*. The first fixing portion 82*a* is joined to the fuel injection device mount portion 34*a*, the second fixing portion 82*b* is joined to the cooling water pipe mount portion 27, and the third fixing portion 82*c* is joined to the cooling water pipe mount portion 27 through a connecting rib 28*b*, thereby improving stiffness of the accessory mount portion 28. Further, since the first and second fixing portions 82*a*, 82*b* are positioned near the fuel injection device mount portion 34*a* and the cooling water pipe mount portion 27 both of which have high stiffness, it is possible to improve the fixing stiffness without increasing the size and the weight by providing a dedicated rib.

As mentioned above, since the accessory mount portion 28*a* is joined to the fuel injection device mount portion 34*a*, the accessory mount portion 28 has high stiffness as the result of being supported by the fuel injection device mount portion 34*a*. This eliminates damage or malfunction of the accessory mount portion 34*a* even when vibration of the engine and the like occurs. Further, with the connection to the fuel injection device mount portion 34*a* that is previously provided on the cylinder head 2, increase in the weight of the engine can be restricted without employing an additional reinforcement member.

As mentioned above, since the intake port 22 bents in a direction away from the fuel injection device mount portion 34*a*, in the relation to the accessory mount portion 28, the intake port 22 bents in such a manner that the upstream side of the intake port 22 is away from the accessory mount portion 28. Therefore, the accessory mount portion 28 can be positioned near the fuel injection device mount portion 34*a* to such an extent that the opening of the intake port 22 bents in a direction away from the accessory mount portion 28, which makes it possible to readily connect the fuel injection device mount portion 34*a* and the accessory mount portion 28.

As mentioned above, since the accessory mount portion 28 is also joined to the cooling water pipe mount portion 27, stiffness of the accessory mount portion 28 is further enhanced, which makes it possible to perform the function of the accessory 8 without increasing the weight.

As mentioned above, since the intake manifold mount surface 24*a* and the accessory mount surface 28*a* are formed in the same plane, these two surfaces can be machined and finished simultaneously. Further, since the intake manifold mount surface 24*a* and the accessory mount surface 28*a* are joined through the connecting rib 29, stiffness of the accessory mount portion 28 can be enhanced. Furthermore, the connecting rib 29 is also provided in the same plane with the accessory mount surface, which enhances the stiffness.

Furthermore, according to the preferred embodiment of the invention, since the accessory mount portion 28 to which the accessory 8 such as a spool valve and an EGR valve is mounted is arranged at the transmission system side, it is possible to utilize space effectively at the transmission system side.

In the aforementioned preferred embodiment of the invention, a spool valve is employed as the accessory 8. The spool valve is used for switching hydraulic pressure to drive a variable valve timing mechanism. Accordingly, the accessory mount surface 28*a* requires high stiffness to seal hydraulic pressure. In this regard, according to the embodiment, enhancing the stiffness of the accessory mount surface 28*a* (accessory mount portion 28) makes it possible to secure hydraulic pressure to drive the variable valve timing mechanism. This can improve the responsiveness of the variable valve timing mechanism. Further, since the accessory mount portion 28 is provided at the intake side, the accessory mount portion 28 is not subjected to excessive heat, thereby restricting deterioration of the oil and stabilizing the hydraulic pressure. Therefore, it is possible to improve accuracy in controlling the spool valve.

While the invention has been described in detail with reference to a specific embodiment thereof, it will be apparent to one skilled in the art that the present invention is not limited to the specific embodiment. For example, the number of valves and spark plugs 33 to be mounted on the cylinder head 2 is not limited, and four or five valves maybe provided for each combustion chamber 21, or only one spark plug 33 may be employed for each combustion chamber 21.

Further, the joint of the accessory mount portion 28*a* with the fuel injection device mount portion 34*a*, the cooling water pipe mount portion 27, and the intake manifold mount portion 24 may be formed such that part of these portions overlap each other. Alternatively, these portions are joined through a rib.

Furthermore, although the embodiment has been described in the case of a gasoline engine, the present invention is applicable to other engine such as a diesel engine.

What is claimed is:

1. In a cylinder head of an engine having an intake port communicating with a combustion chamber of the engine, a mount structure for an engine accessory comprising:

a spool valve for switching hydraulic pressure to drive a variable valve timing mechanism;

a spool valve mount portion provided at an intake side of the cylinder head where the intake port is open, and to which is mounted the spool valve as an engine accessory; and a cooling water pipe mount portion provided on the cylinder head and to which a cooling water pipe is mounted, the cooling water pipe for circulating therein cooling water to cool the interior of the engine;

wherein the spool valve mount portion is joined to the cooling water pipe mount portion.

2. A mount structure for an engine accessory according to claim 1, wherein said intake port is bent in such a manner that an upstream side of the intake port is away from the spool valve mount portion.

3. A mount structure for an engine accessory according to claim 1, wherein said intake port is bent in such a manner that an upstream side of the intake port is away from the spool valve mount portion.

4. A mount structure for an engine accessory according to claim 1, wherein said spool valve mount portion is provided at a power transmission device side.

5. A mount structure for an engine accessory according to claim 1, wherein said spool valve mount portion is provided at an intake side.

6. A mount structure for an engine accessory according to claim 1, wherein said spool valve mount portion is joined to an intake manifold mount portion to which is mounted an intake manifold communicating with the intake port, such that the spool valve mount portion and the intake manifold mount portion are formed in the same plane.

7. A mount structure for an engine accessory according to claim 6, wherein said spool valve mount portion is provided at a power transmission device side.

8. A mount structure for an engine accessory according to claim 6, wherein said spool valve mount portion is provided at an intake side.

9. A mount structure for an engine accessory according to claim 6, wherein a fuel injection device mount portion, to which is mounted a fuel injection device for injecting fuel into the intake port, is joined to the spool valve mount portion.

10. A mount structure for an engine accessory according to claim 9, wherein said intake port is bent in such a manner that an upstream side of the intake port is away from the spool valve mount portion.

11. A mount structure for an engine accessory according to claim 10, wherein said fuel injection device mount portion projects outward further than a spark plug insertion hole provided in the cylinder head.

12. A mount structure for an engine accessory according to claim 9, wherein said fuel injection device mount portion projects outward further than a spark plug insertion hole provided in the cylinder head.

13. A mount structure for an engine accessory according to claim 9, wherein said spool valve mount portion is provided at a power transmission device side.

14. A mount structure for an engine accessory according to claim 9, wherein said spool valve mount portion is provided at an intake side.

15. In a cylinder head of an engine having an intake port communicating with a combustion chamber of the engine, a mount structure for an engine accessory comprising:

an engine accessory;

an accessory mount portion provided on the cylinder head and to which the engine accessory is mounted;

a fuel injection device mount portion provided on the cylinder head and to which a fuel injection device is mounted, the fuel injection device for injecting fuel into the intake port;

wherein the accessory mount portion is joined to the fuel injection device mount portion and wherein said accessory mount portion and said fuel injection device mount are joined by a connecting rib.

16. In a cylinder head of an engine having an intake port communicating with a combustion chamber of the engine, a mount structure for an engine accessory comprising:

an engine accessory;

an accessory mount portion provided on the cylinder head and to which the engine accessory is mounted; and a cooling water pipe mount portion provided on the cylinder head and to which a cooling water pipe is mounted, the cooling water pipe for circulating therein cooling water to cool the interior of the engine;

a fuel injection device mount portion provided on the cylinder head;

wherein the accessory mount portion is joined to the cooling water pipe mount portion and wherein said accessory mount portion and said fuel injection device mount portion are joined by a connecting rib.

17. In a cylinder head of an engine having an intake port communicating with a combustion chamber of the engine, a mount structure for an engine accessory comprising:

an engine accessory;

an accessory mount portion provided on the cylinder head and to which the engine accessory is mounted; and an intake manifold mount portion provided on the cylinder head and to which ah intake manifold is mounted, the intake manifold communicating with the intake port;

wherein the accessory mount portion is joined to the intake manifold portion and wherein said accessory mount portion and said intake manifold mount portion are joined by a connecting rib.

18. In a cylinder head of an engine having an intake port communicating with a combustion chamber of the engine, a mount structure for an engine accessory comprising:

an engine accessory;

an accessory mount portion provided on the cylinder head and to which the engine accessory is mounted;

an intake manifold mount portion provided on the cylinder head and to which an intake manifold is mounted, the intake manifold communicating with the intake port; and a fuel injection device mount portion;

wherein the accessory mount portion is joined to the intake manifold portion, wherein said intake port is bent in such a manner that an upstream side of the intake port is away from the accessory mount portion, wherein an intake manifold mount surface of the intake manifold mount portion and an accessory mount surface of the accessory mount portion are formed in the same plane, and wherein said accessory mount portion and said fuel injection device mount portion are joined by a connecting rib and wherein said connecting rib is formed in the same plane with the intake manifold mount surface and the accessory mount surface.

* * * * *